US007963614B2

(12) United States Patent
Kranz et al.

(10) Patent No.: US 7,963,614 B2
(45) Date of Patent: Jun. 21, 2011

(54) SEAT BELT BUCKLE

(75) Inventors: Christopher Joe Kranz, Troy, MI (US); Paul Michael Smith, Davison, MI (US); Thomas Mogg, Shelby Township, MI (US)

(73) Assignee: TK Holdings Inc., Auburn Hills, MI (US)

( * ) Notice: Subject to any disclaimer, the term of this patent is extended or adjusted under 35 U.S.C. 154(b) by 0 days.

(21) Appl. No.: 12/875,903

(22) Filed: Sep. 3, 2010

(65) Prior Publication Data

US 2010/0325845 A1 Dec. 30, 2010

Related U.S. Application Data

(63) Continuation-in-part of application No. 12/385,152, filed on Mar. 31, 2009, now Pat. No. 7,794,024.

(51) Int. Cl.
*A62B 35/00* (2006.01)
*A41F 9/00* (2006.01)

(52) U.S. Cl. ..... 297/484; 297/467; 24/579.11

(58) Field of Classification Search ..... 24/580.1, 24/579.11; 297/483, 484, 467, 464, 250.1, 297/463.1

See application file for complete search history.

(56) References Cited

U.S. PATENT DOCUMENTS 2,430,341 A * 11/1947 Johnston ..... 24/579.11
3,234,436 A 2/1966 Bieger
3,278,875 A 10/1966 McDonough
3,747,167 A * 7/1973 Pravaz ..... 24/573.11
4,101,858 A 7/1978 Henninger
6,367,882 B1 4/2002 Van Druff et al.
6,543,101 B2 4/2003 Sack et al.
6,719,326 B2 4/2004 Schroth et al.
7,117,568 B2 10/2006 Nolan

OTHER PUBLICATIONS

U.S. Appl. No. 12/385,150, filed Mar. 31, 2009.
U.S. Appl. No. 12/453,246, filed May 4, 2009.

* cited by examiner

*Primary Examiner* — Milton Nelson, Jr.
(74) *Attorney, Agent, or Firm* — Foley & Lardner LLP

(57) ABSTRACT

A buckle assembly configured to mate with a plurality of tongues may include a rotational lever; a latch plate supported by the rotational lever and configured to move in a vertical direction when the lever rotates; a plurality of latch pins, wherein each latch pin is configured to engage the latch plate at one end of the pin and one of the plurality of tongues at the other end of the pin in order to mate the tongue with the buckle assembly; and a rotational solenoid. A core of the rotational solenoid may be connected to the rotational lever, so that rotation of the core causes the lever to rotate and the latch plate to move in a vertical direction. Each of the latch pins is configured to disengage from the corresponding tongue when the lever rotates.

5 Claims, 7 Drawing Sheets

SEAT BELT BUCKLE

CROSS-REFERENCE TO RELATED APPLICATIONS

This application is a Divisional of U.S. application Ser. No. 12/385,152, filed Mar. 31, 2009.

BACKGROUND

This application relates generally to the field of vehicle occupant restraint systems. More particularly, this application relates to a harness belt having a buckle assembly configured to release a plurality of seat belts in response to a remote actuator.

Conventional harness belts for vehicles are configured to secure the vehicle occupant to a seat during rapid acceleration and deceleration of the vehicle. These restraint systems can be found in front seats, rear seats, third seats, etc., or any combination thereof.

Conventional harness belts for vehicles require an occupant to manually release a buckle in order to free the occupant from the harness belt. However, there is a need for a remote release capability. In the event of an emergency vehicle situation, such as a sudden stop, collision, rapid change of altitude, fire, etc. it may become necessary to release the harness belt buckle remotely in order to facilitate the quick exit of occupants who may require assistance with their harness belt. The release of the buckle may be actuated by, for example, a vehicle operator, other vehicle occupants, emergency personnel, etc. For example, in a racing vehicle, it may be difficult for a driver to both unbuckle himself and exit safely in an emergency. Other potential applications could include harness belt buckles used in automobiles, trains, airplanes, motor coach buses, etc.

SUMMARY

Based on the foregoing, it is desirable for a buckle to incorporate the ability to be released by remote input, in the event of an emergency situation. The remote release mechanism may be either mechanical or electrical. For example, an electrical signal may be used to actuate an electromechanical device. The buckle should maintain full mechanical functionality, such that the buckle can mechanically release, in the event of power failure.

It is also desirable for the buckle to be compatible with current restraint components, so that the cost of altering an existing vehicle restraint system is reduced.

It is also desirable that the buckle enable occupants to exit the vehicle quickly.

One disclosed embodiment relates to a buckle assembly configured to mate with a plurality of tongues that includes a rotational lever; a latch plate supported by the rotational lever and configured to move in a vertical direction when the lever rotates; a plurality of latch pins, wherein each latch pin is configured to engage the latch plate at one end of the pin and one of the plurality of tongues at the other end of the pin in order to mate the tongue with the buckle assembly; and a rotational solenoid. A core of the rotational solenoid may be connected to the rotational lever, so that rotation of the core causes the lever to rotate and the latch plate to move in a vertical direction. Each of the latch pins may be configured to disengage from the corresponding tongue when the lever rotates.

Another disclosed embodiment relates to a buckle assembly configured to mate with a plurality of tongues that includes a rotational lever; a latch plate supported by the rotational lever and configured to move in a vertical direction when the lever rotates; a plurality of latch pins, wherein each latch pin is configured to engage the latch plate at one end of the pin and one of the plurality of tongues at the other end of the pin in order to mate the tongue with the buckle assembly; and an electromagnet. Each of the latch pins may be configured to disengage from the corresponding tongue when the electromagnet exerts an electromagnetic force on the latch pins.

Yet another disclosed embodiment relates to a harness belt for use in an occupant restraining device including a buckle; a pair of lap belts, a pair of shoulder belts, and a crotch belt secured to the buckle; and tongues secured to each of the pair of lap belts, the pair of shoulder belts, and the crotch belt, the tongue configured to detachably engage with the buckle assembly. The buckle may include a rotational lever; a latch plate supported by the rotational lever and configured to move in a vertical direction when the lever rotates; a plurality of latch pins, where each latch pin is configured to engage the latch plate at one end of the pin and one of the plurality of tongues at the other end of the pin in order to mate the tongue with the buckle; and a rotational solenoid. The core of the rotational solenoid may be connected to the rotational lever, so that rotation of the core causes the lever to rotate and the latch plate to move in a vertical direction. Each of the latch pins may be configured to disengage from the corresponding tongue when the lever rotates.

It is to be understood that the foregoing general description and the following detailed descriptions are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

DETAILED DESCRIPTION

A buckle assembly is illustrated that has the ability to remotely release a plurality of tongues from a buckle through an electric signal while maintaining full mechanical functionality in the event of power failure to allow for manual release of the buckle assembly.

The buckle assembly maintains all of the redundant safety and convenience of a typical mechanical buckle, but adds the ability for someone other than the seat occupant to release the plurality of tongues from the buckle remotely by using a button, switch, or other device mounted elsewhere in the vehicle or outside of the vehicle to activate the buckle. The remote device provides an actuation signal to an electromechanical device included in the buckle. The electromechanical device controls the release of the plurality of tongues from the buckle. Examples of electromechanical devices may include a rotational solenoid or an electromagnet.

The signal to remotely release the plurality of tongues from the buckle can be sent by any number of means, including through a wire (e.g., CANBUS communication, a simple current pulse, etc.), or wirelessly (e.g., "Bluetooth" type communication). The signal activates an electromechanical device included in the buckle that when powered exerts a force on latch pins to release the tongues from the buckle. As the latch pins move in a vertical direction, a biasing mechanism forcibly moves the tongues, allowing the tongues to be released from the buckle.

In an exemplary embodiment, in case of emergency, the tongues can be remotely released by the vehicle driver, a rescue personnel, etc. to facilitate the quick exit of occupants who may otherwise need special assistance with their harness belt. One exemplary application is race cars. It can be very difficult for a race car driver to unbuckle oneself and safely exit the vehicle during an emergency. Other potential applications include automobiles, and mass-transit vehicles, such as motor coaches, military transport vehicles, trains, airplanes, etc.

By configuring the buckle so that the electromechanical device does not directly act on the biasing mechanism, but rather operates on the latch pins after the buckle has properly been latched, the buckle maintains the ability to be used in a traditional manner (i.e., manually operating), with a manually operable dial, even though the buckle is also designed to be released remotely, thereby unaffecting normal buckle function. This ensures that the structural load path within the buckle is unaffected by the presence of the electromechanical device and the force required to actuate the latch pins with the manually operable dial is not changed.

In a preferred embodiment, the electromechanical device is configured to move the lock pins in a vertically upward direction. When this occurs the biasing mechanism moves in a horizontal direction, such that the tongues are no longer retained in a "lock" position, which causes the tongues to be released from the buckle.

Figure 1:
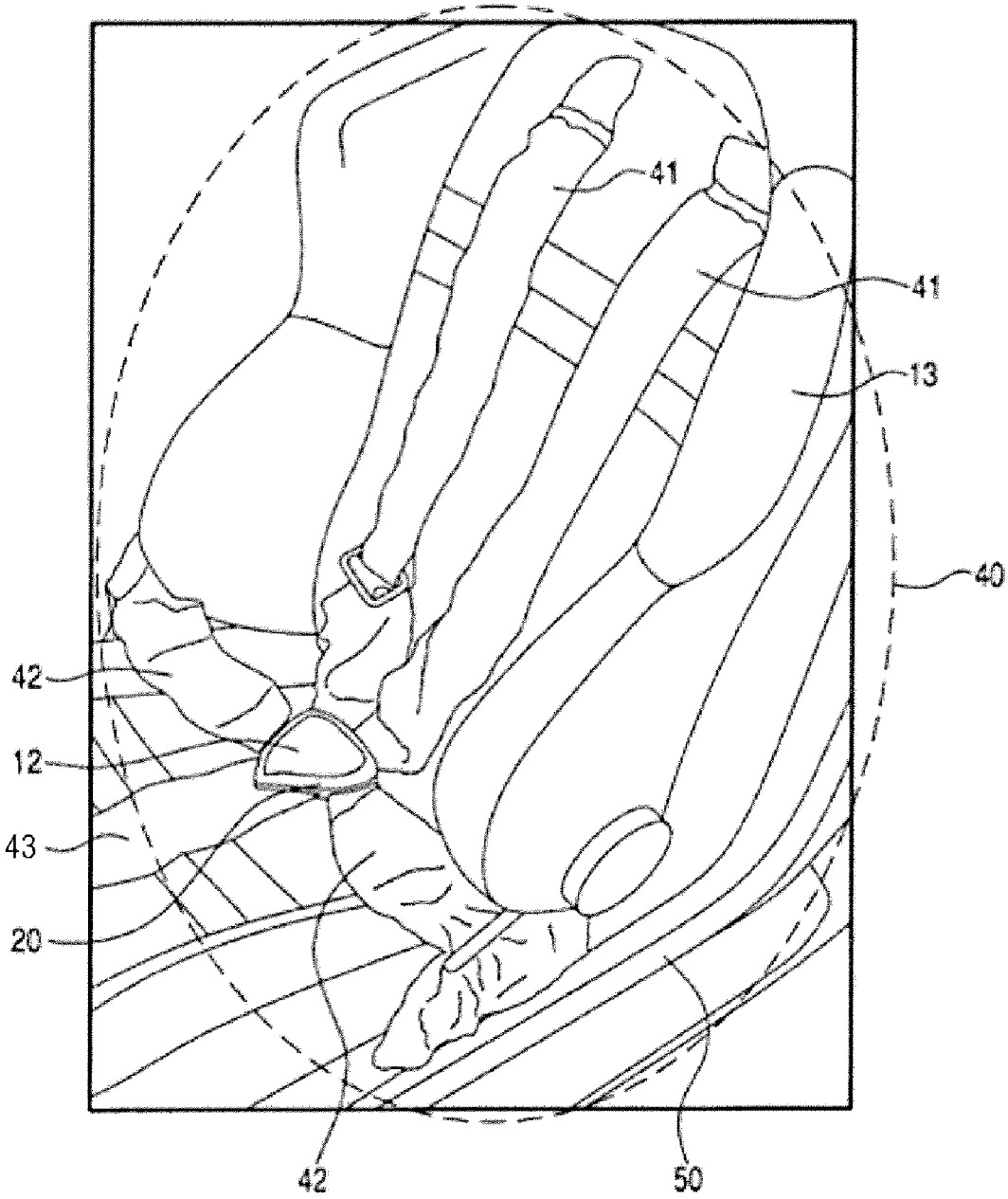
FIG. 1 shows a view of a portion of a vehicle including a harness belt having a buckle assembly according to an exemplary embodiment.

Various disclosed embodiments are now described by referring to the accompanying drawings. FIG. 1 shows a portion of a vehicle illustrating an example of a harness belt having a buckle. Referring to FIG. 1, a portion of a vehicle 50 is shown according to an exemplary embodiment having one seat 13 including a harness type seat belt system 40 configured to restrain an occupant in the seat 13. The portion of the vehicle 50 shown is part of a racing vehicle. According to other exemplary embodiments, the vehicle 50 may be a truck, sport utility vehicle, crossover vehicle, etc. school, commercial, or motor-coach bus. According to still other embodiments, the vehicle 50 may be any other type of motor vehicle including military transport vehicles, trains, airplanes, etc.

The seat 13 includes a harness type seat belt system 40. The harness belt system 40, may include five belts. According to another exemplary embodiment the harness belt system 40 may include more or less than five belts. The buckle 20 shown includes five openings for five tongues. According to another exemplary embodiment the buckle 20 may include more or less than five openings in order to correspond to more or less than five tongues.

The harness system 40 shown in FIG. 1 includes two shoulder belts 41, two lap belts 42, and a crotch belt 43. The two shoulder belts 41, the two lap belts 42, and the crotch belt 43 are joined together in a buckle 20. The buckle 20 is located centrally on the seat 13 in front of the body of the vehicle 50 occupant.

The two shoulder belts 41, the two lap belts 42, and the crotch belt 43 are each provided with a tongue that can be inserted into the buckle 20. When the tongues are inserted into the buckle 20, the tongues can be manually released by an occupant or remotely released.

FIGS. 2-5 disclose a buckle 20 for use in a harness belt system 40. The buckle 20 includes a rotational lever 4, a latch plate 7, latch pins 9, a manually operable dial 12, and a rotational solenoid 1.

The rotational solenoid 1 may include a core 33. When an electric current is sent to the core 33, the core 33 rotates. The core 33 includes a stator. The core 33 and stator (not separately shown) are integrally shown in FIG. 5 as one piece for the purpose of simplifying the drawing. The core 33 and stator are configured as separate parts. A coil (not shown) may be mounted on the core 33 for establishing a magnetic field. When the coil is energized a magnetic flux is generated in the stator, causing the core 33 of the rotational solenoid 1 to rotate. The rotational solenoid 1 may be any suitable rotational solenoid. For example, U.S. Pat. No. 4,101,858 describes an example of a suitable rotational solenoid. The description of the rotational solenoid contained in the aforementioned patent is herein incorporated by reference.

Figure 2:
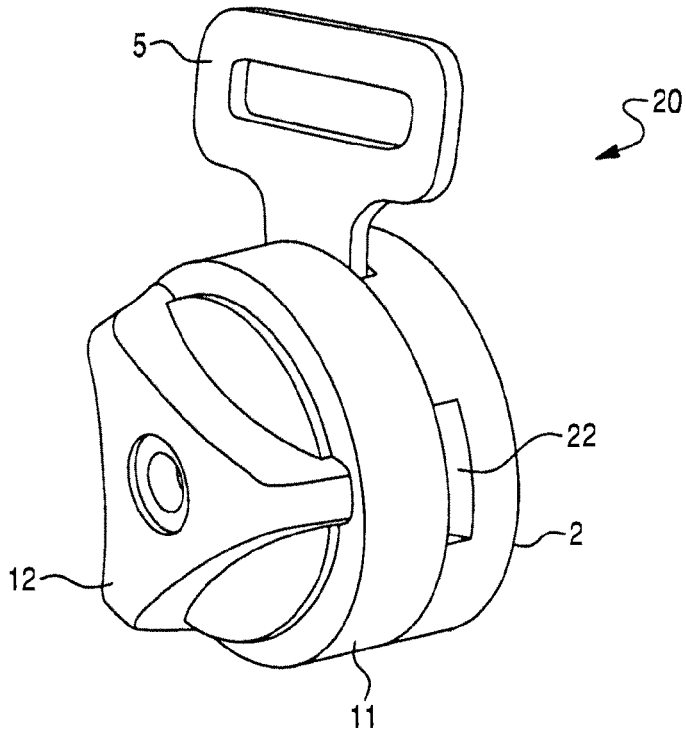
FIG. 2 shows a side view of an assembled buckle assembly including a rotational solenoid according to one embodiment.
Figure 3:
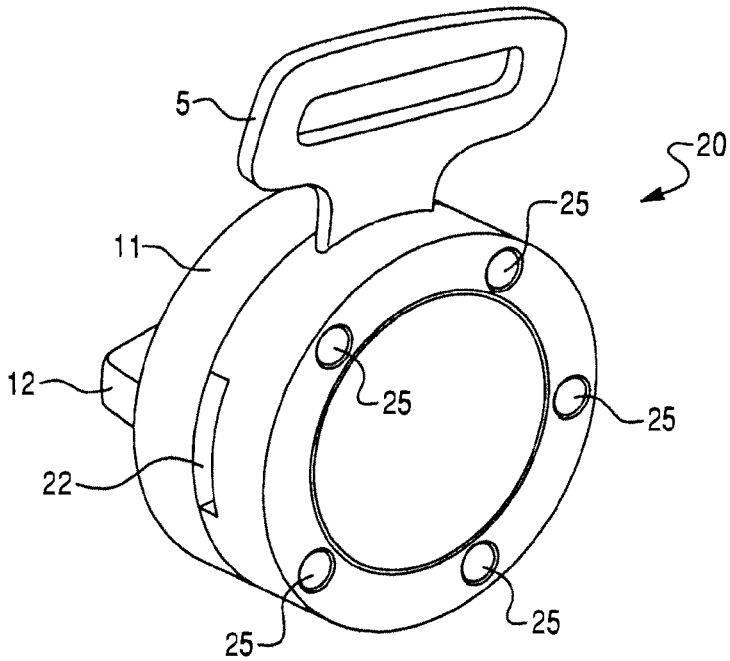
FIG. 3 shows a back view of the buckle of FIG. 2.

As shown in FIGS. 2-3, a dial 12 is mounted on a base 11. The dial 12 includes a gripping portion to facilitate manual operation. The base 11 supports the manually operable dial 12 and a cover 2 supports the base 11. The base 11 includes a plurality of tongue openings 22 or openings 22. FIGS. 2-3 illustrate only one tongue 5, though the base 11 may include up to five openings 22 for up to five tongues 5. Solenoid pins 25 or pins 25 couple the rotational solenoid 1 to the base 11.

Figure 4:
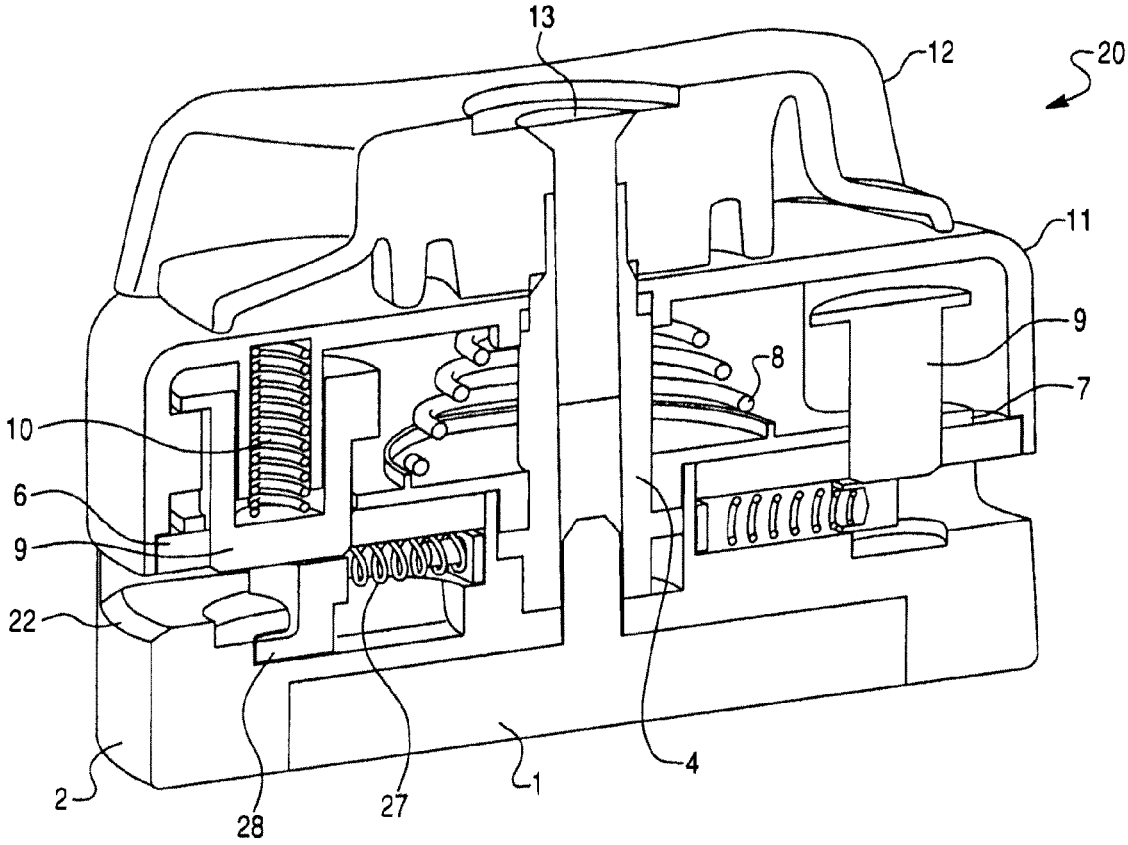
FIG. 4 shows an assembled cross section of the buckle assembly of FIG. 2 in an unbuckled state.
Figure 5:
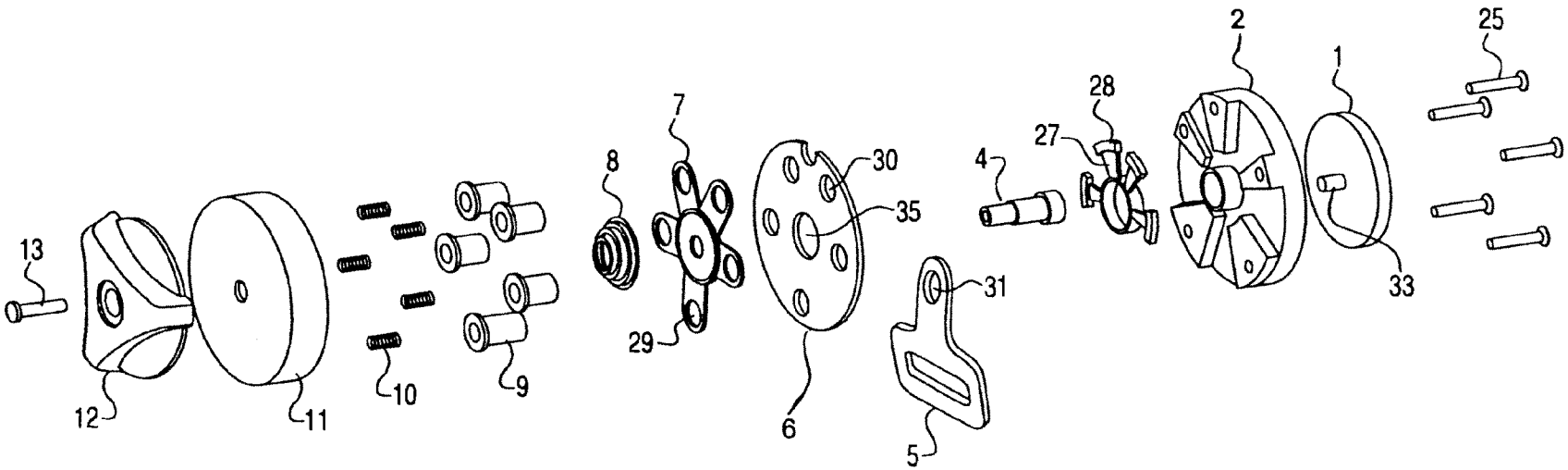
FIG. 5 shows an exploded perspective view of the buckle assembly of FIG. 2.

FIGS. 4-5 show a cross section of the buckle 20 and an exploded view of the buckle 20. FIG. 4 shows the buckle 20 when the tongues 5 have been released from the buckle 20. As shown in FIG. 4, the rotational solenoid 1 is coupled to the rotational lever 4 and the lever 4 is coupled to a pin 13. When the core 33 of the solenoid 1 rotates, the lever 4 also rotates.

The pin 13 is also coupled to the manually operable dial 12. During manual operation of the buckle 20, the rotation of the dial 12 is transmitted to the lever 4 via the pins 13.

The inner portions of the base 11 include latch pins 9, a biasing member 8, a latch plate 7, a latch base 6, and a portion of the rotational lever 4. Each of the latch pins 9 includes a biasing member 10. According to one embodiment, there are five latch pins 9 and five biasing members 10 and each latch pin 9 includes a biasing member 10. The biasing member is preferably a coil spring. According to another embodiment there may be more or less than five latch pins 9 and more or less than five biasing members 10. The biasing members 10 are configured to bias the latch pins 9.

The latch pins 9 are configured to engage the latch plate 7. When the latch plate 7 exerts a force on the latch pins 9, the biasing members 10 bias the latch pins 9 causing the latch pins 9 to move in a vertical direction. The vertical direction may be up or down depending on whether the biasing members are compressed or decompressed.

The other end of the latch pins 9 are configured to engage one of the tongues 5 in order to mate the tongue 5 with the buckle 20. The tongues 5 each include an opening 31. Each latch pin 9 is dimensioned to slidably insert into a corresponding opening 31. The cover 2 also includes a plurality of openings 22. Each of the openings 22 is dimensioned to fit a corresponding tongue 5. When the tongues 5 are inserted into the openings 22, the tongues 5 contact a biasing mechanism 3. The biasing mechanism 3 is supported by the base 11 and includes a plurality of biasing members 27 and a plurality of latches 28. According to one embodiment there are five latches 28 and ten biasing members 27. Each latch 28 is coupled to two of the ten biasing members 27. In yet another embodiment, there may be more or less than five latches 28 and more or less than ten biasing members 27. The biasing members 27 may be springs.

When the tongues 5 are positioned in the openings 22, the latches 28 of the biasing mechanism 3 exert a force on the biasing members 27. The force exerted by the latches 28 biases the biasing members 27 of the biasing mechanism 3. The biasing members 27 are compressed. When the biasing members 27 are compressed, the latch pin 9 engages the openings 31, thereby putting the tongues 5 in a "lock" position. When the biasing members 27 of the biasing mechanism are decompressed, the latch pins 9 are disengaged from the openings 31, thereby enabling the tongues 5 to release from the buckle 20.

Each latch pin 9 is also configured to engage the latch base 6. The latch base 6 includes a plurality of openings 30, 35. The latch pins 9 are dimensioned to fit inside of the openings 30. A biasing member 8 is dimensioned to surround the opening 35 and the lever 4 is dimensioned to slidably insert into the opening 35. Each latch pin 9 is configured to engage a tongue 5 in order to lock the tongue 6 in an engaged position with the buckle 20. The latch pins 9 engage the cover 2 when the tongues 5 are in a "lock" position and disengage from the cover 2 when the tongues 5 release from the buckle 20. The biasing member 8 may be a spring.

The biasing member 8 is supported by the latch plate 7 and surrounds a portion of the lever 4. The latch base 6 supports the latch plate 7. The latch plate 7 includes openings 29. When the latch pins 9 engage the latch base 6, the latch pins 9 slidably insert into the openings 29 of the latch plate 7.

During manual operation of the buckle 20, a user rotates the manually operable dial 12. As the user rotates the dial 12, the lever 4 rotates. The rotating lever 4 exerts a force on the latch plate 7. The latch plate 7 exerts a force on the biasing member 8 causing the biasing member 8 to force the latch plate 7 to move in a vertical direction. When the latch plate 7 moves, it exerts a force on the latch pins 9. The force exerted on each of the latch pins 9 is sufficient to overcome the force of the biasing members 10 and allow the latch pins 9 to move in a vertically upward direction. The movement of the latch pins 9 causes the openings 31 of the tongues 5 to disengage from the latch pins 9. When the latch pins 9 disengage from the tongues 5, a force is exerted on the latches 28, causing the biasing members 27 to bias and the latches 28 to move in a horizontal direction toward the rotational lever 4. The movement of the latches 28 releases or disengages the tongues 5 from the buckle 20.

Remote operation of the buckle 20 shown in FIGS. 2-5 operates similar to manual operation of the buckle 20 shown in FIGS. 2-5. However, during remote operation, the manually operable dial 12 remains stationary. The remote release mechanism sends an actuation signal to the core 33 of the rotational solenoid 1, thereby causing the core 33 to rotate. Rotation of the core 33 causes the lever 4 to rotate.

Figure 6:
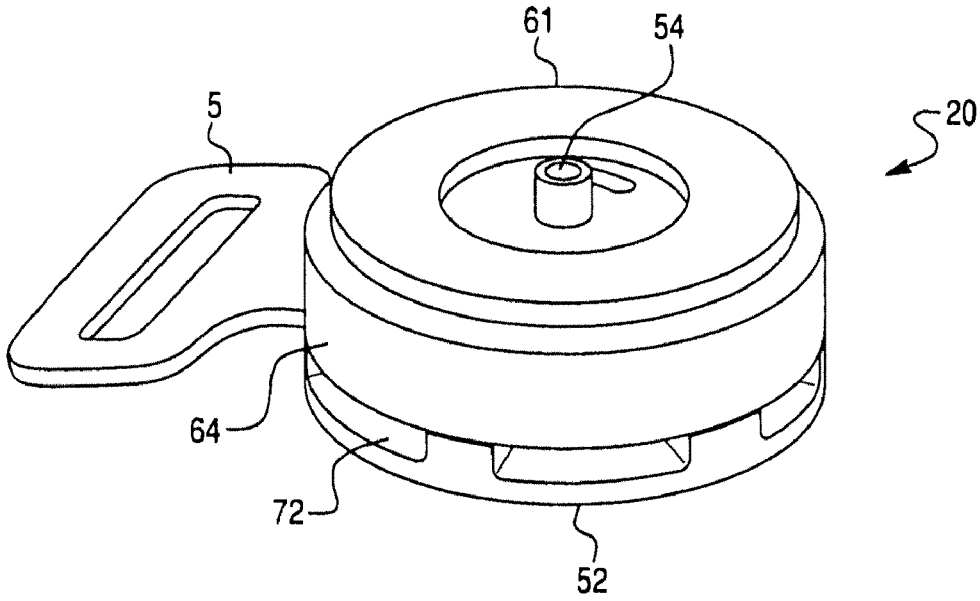
FIG. 6 shows a side view of an assembled buckle assembly including an electromagnet according to another embodiment.
Figure 7:
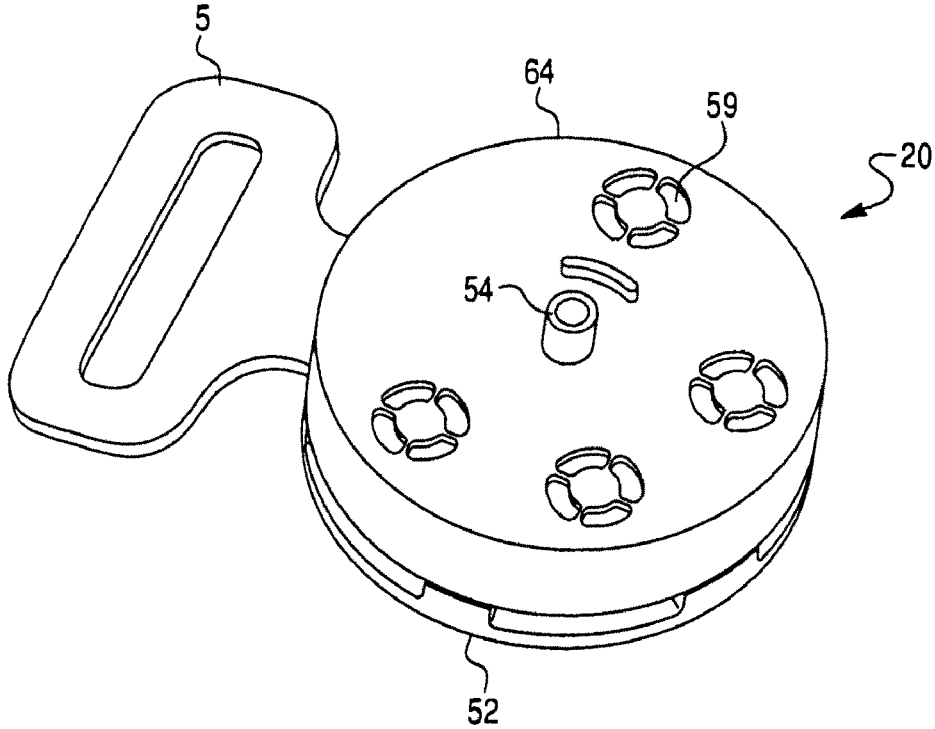
FIG. 7 shows a back view of the buckle assembly of FIG. 6.
Figure 8:
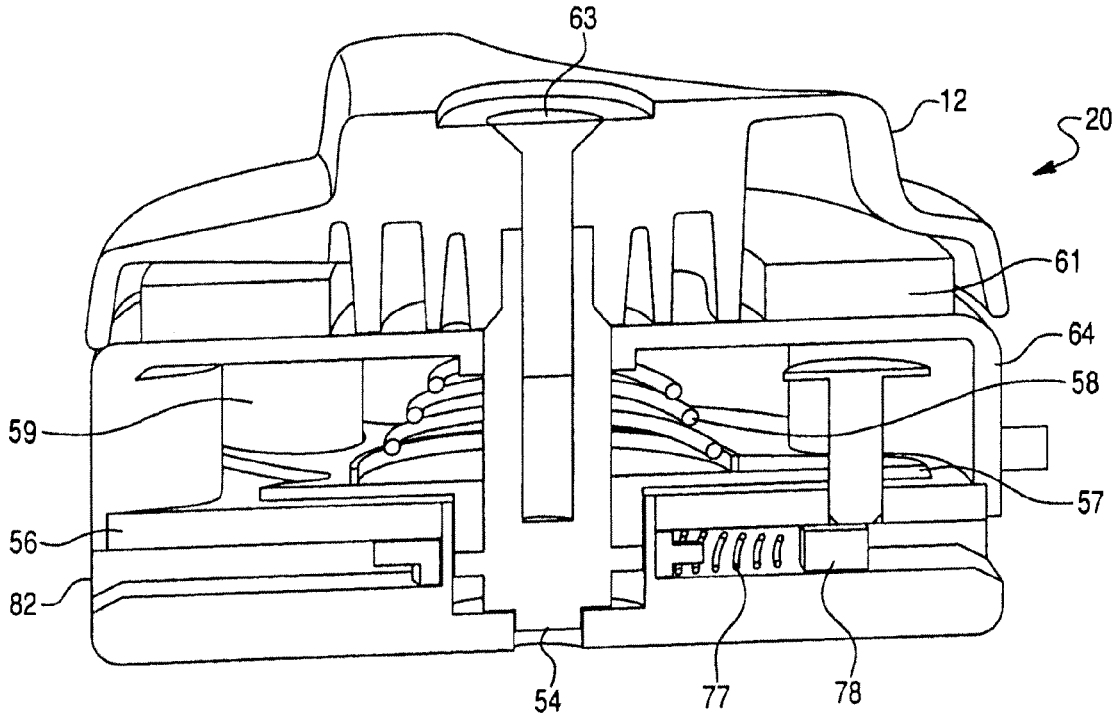
FIG. 8 shows an assembled cross section of the buckle assembly of FIG. 7 in an unbuckled state.
Figure 9:
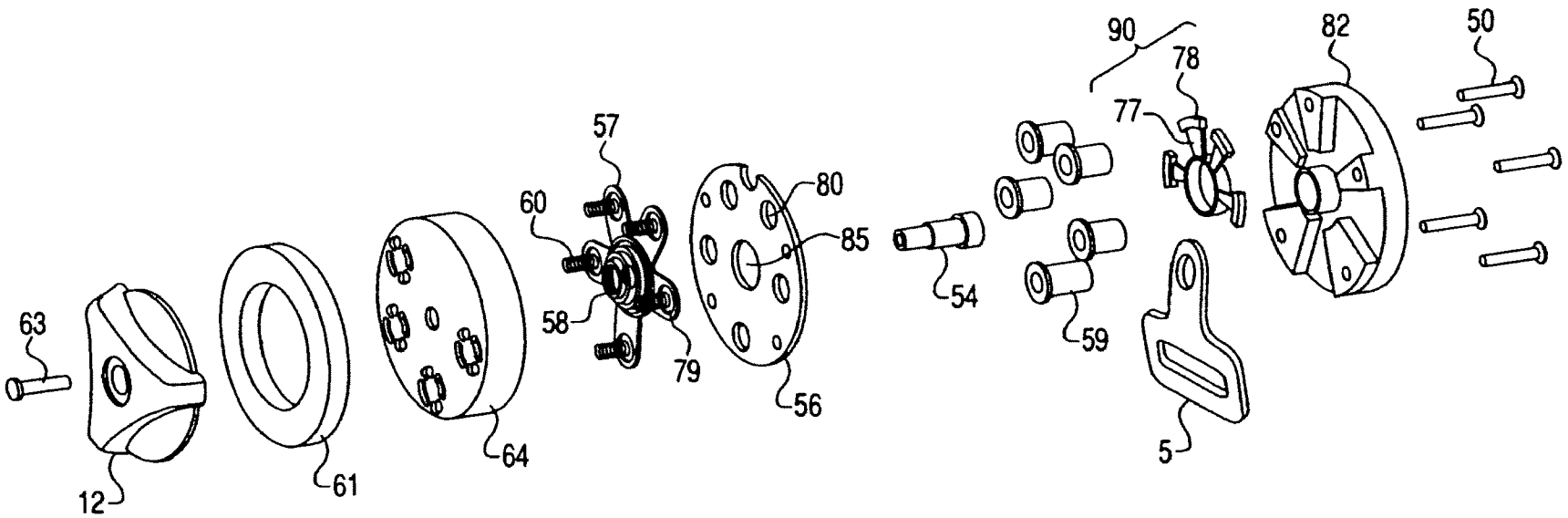
FIG. 9 shows an exploded perspective view of the buckle assembly of FIG. 7.

FIGS. 6-9 show another embodiment of the buckle 20. As shown in FIGS. 6-7, the buckle 20 includes a rotational lever 54 or lever 54, a plurality of tongues 5 (only one shown), an electromagnet 61, latch pins 59, a base 64, and a cover 52.

FIG. 6 shows an embodiment of the buckle 20 before a manually operable dial 12 is placed on the buckle 20. The rotating lever 54 may extend from the inner portions of the buckle 20 to the dial 12. The lever is coupled to the dial 12. Similar to the embodiment shown in FIGS. 2-5, the latch pins 59 may lie flush against a surface of the base 64.

Manual operation of the buckle 20 shown in FIGS. 6-9 is substantially the same as the manual operation of the buckle 20 shown in FIGS. 2-5. The parts shown in FIGS. 6-9 that are similar to those parts shown in FIGS. 2-5 have some different reference numerals. The buckle 20 of FIGS. 6-9 includes pins 50; a cover 82; the biasing mechanism 90; latches 78; biasing members 77; latch pins 59; the rotational lever 54; the latch base 56; openings 80, 85; the latch plate 57; biasing members 60; openings 79; the cover 64; the dial 12; an electromagnet 61; and a pin 63.

Remote operation of the buckle 20 as shown in FIGS. 6-9 operates similar to remote operation of the buckle 20 shown in FIGS. 2-5. However, during remote operation of the buckle 20 as shown in FIGS. 6-9, the rotational lever 54 does not rotate. Instead, an electromagnet 61 is energized by an electrical current controlled by a remote release mechanism. When the remote release mechanism causes an electric current to be supplied to the electromagnet 61, an electromagnetic force is exerted on the latch pins 59, causing the latch pins 59 to disengage from the tongues and move toward the electromagnet 61. When the latch pins 59 move a sufficient distance, the tongues 5 may disengage or release from the latch pins 59, thereby causing the tongues 5 to release or disengage from the buckle 20.

It is important to note that the construction and arrangement of the buckle assembly and harness belt as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosure herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. Other substitutions, modifications, changes and omissions may be made in the design, operating conditions and arrangement of the exemplary embodiments.

What is claimed is:

1. A buckle assembly configured to mate with a plurality of tongues comprising:

a rotational lever;

a latch plate supported by the rotational lever and configured to move in a vertical direction when the lever rotates;

a plurality of latch pins, wherein each latch pin is configured to engage the latch plate at one end of the pin and one of the plurality of tongues at the other end of the pin in order to mate the tongue with the buckle assembly; and an electromagnet, wherein each of the latch pins is configured to disengage from the corresponding tongue when the electromagnet exerts an electromagnetic force on the latch pins.

2. The assembly of claim 1, wherein the buckle assembly further comprises a manually operable dial connected to the lever so that when the dial is rotated the lever rotates to disengage each of the latch pins from the corresponding tongue so that each of the tongues is unmated from the buckle assembly.

3. The assembly of claim 1, wherein the latch pins are configured to move in a vertical direction.

4. The assembly of claim 1, further comprising a biasing mechanism, the biasing mechanism configured to move each of the plurality of tongues in a horizontal direction.

5. The assembly of claim 4, wherein the biasing mechanism comprises:

a plurality of latches, each latch configured to engage one of the tongues; and a plurality of biasing members configured to bias the latches.

* * * * *